US005879229A

United States Patent [19]

Anderson

[11] Patent Number: 5,879,229

[45] Date of Patent: Mar. 9, 1999

[54] ICE SKATE BLADE RESURFACER

[75] Inventor: Bradley J. Anderson, Alexandria, Minn.

[73] Assignee: Edge Specialities, Inc., Alexandria, Minn.

[21] Appl. No.: 878,237

[22] Filed: Jun. 18, 1997

[51] Int. Cl.[6] ..... B24D 15/00

[52] U.S. Cl. ..... 451/523; 451/555; 451/556; 451/558

[58] Field of Search ..... 76/82.2, 86, 88, 76/89; 451/45, 555, 556, 558, 557, 540; 452/552, 541, 545, 548, 293, 294

[56] References Cited

U.S. PATENT DOCUMENTS

| | | | |
|---|---|---|---|
| 15,001 | 12/1856 | Berghman . | |
| D. 392,536 | 3/1998 | Anderson | D8/91 |
| 594,723 | 11/1897 | Boettcher . | |
| 750,696 | 1/1904 | Price . | |
| 927,131 | 7/1909 | Dow . | |
| 1,006,000 | 10/1911 | Oosdyke . | |
| 1,170,898 | 2/1916 | Hancock | 76/86 |
| 1,468,347 | 9/1923 | Graves | 76/83 |
| 2,032,640 | 3/1936 | Swetta et al. . | |
| 2,398,566 | 4/1946 | Talbert . | |
| 4,219,975 | 9/1980 | Scholler . | |
| 4,494,340 | 1/1985 | Carter | 451/555 |
| 4,815,240 | 3/1989 | Larson . | |
| 4,872,378 | 10/1989 | Wrench | 76/86 |
| 5,189,845 | 3/1993 | Courchesne . | |
| 5,197,232 | 3/1993 | Ellestad . | |
| 5,383,307 | 1/1995 | Anderson . | |
| 5,431,597 | 7/1995 | Anderson . | |
| 5,591,069 | 1/1997 | Wurthman . | |

FOREIGN PATENT DOCUMENTS

| | | |
|---|---|---|
| 683.014 | 1/1929 | France . |
| 63-7272 | 1/1988 | Japan . |

*Primary Examiner*—David A. Scherbel
*Assistant Examiner*—Derris H. Banks
*Attorney, Agent, or Firm*—Burd, Bartz, Gutenkauf

[57] ABSTRACT

A hand held sharpener has two slots to selectively accommodate the blades of ice hockey skates. A two-piece body having stepped inside housing walls accommodate different diameter and length abrading stones. Fasteners releasably holding the members of the body together can be loosened to allow the different stones to be interchanged.

20 Claims, 4 Drawing Sheets

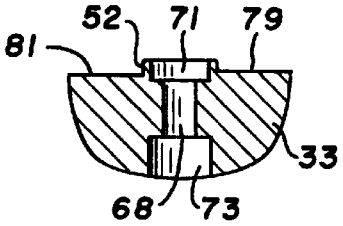
FIG.13
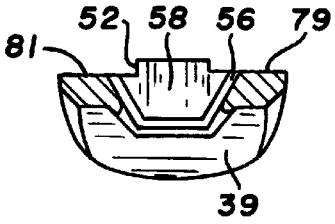
FIG.14
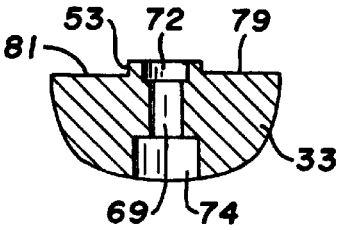
FIG.15
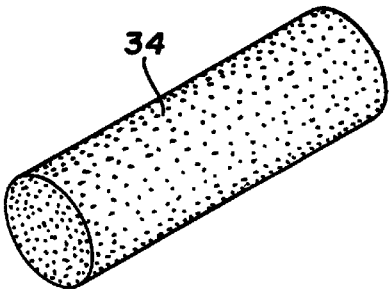
FIG.16
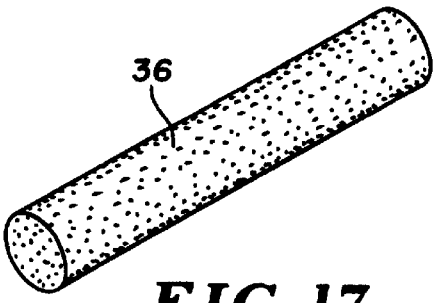
FIG.17
FIG.18
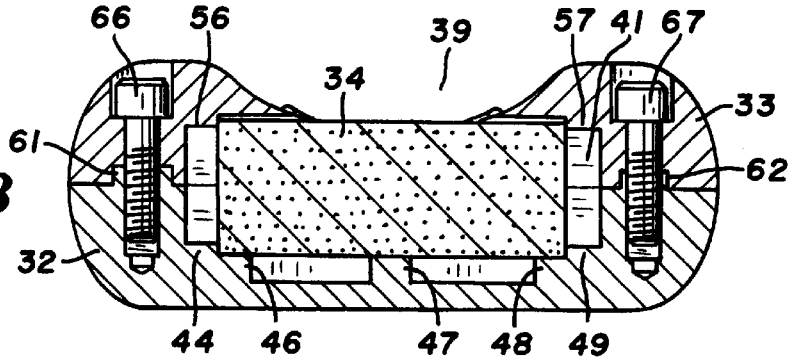
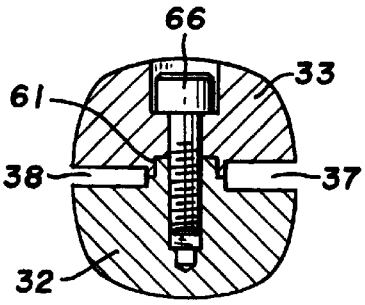
FIG.19
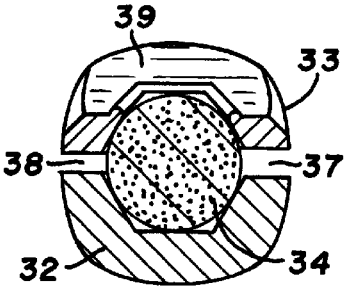
FIG.20
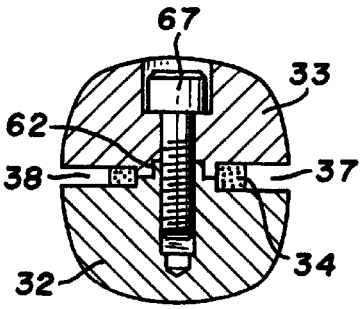
FIG.21

ICE SKATE BLADE RESURFACER

FIELD OF THE INVENTION

The invention relates to tools for sharpening ice skate blades, particularly ice skate blades sharpened with a hollow grind.

BACKGROUND OF THE INVENTION

Typically ice hockey skate blades are sharpened with a hollow grind. This allows the sharpened blade edges to protrude further and dig into the ice surface for added traction. The deeper the hollow, the greater the bite. As the ice skate blade slides on the ice surface during skating, there is constant friction as ice commonly contains microscopic abrasive materials. Friction causes blade wear. As the edges of the skate blade wear down, the hollow diminishes. Mild edge deterioration does not require a thorough grinding. A tuning of the edges will restore the bite. After several tuning sessions it may be necessary to restore the depth of the hollow using a power grinder.

There are many types of ice hockey skate blade grinding machines in use. These machines are adjustable to make a wide range of hollows. The depth of the hollow determines the bite the skate feels as wells as the length of time between sharpening. Ice hockey skate blades differ in hollow size, rocker size and blade width. Deeper hollows, i.e. 5/16 and 3/8 inch radius hollows, generally last longer and provide more bite. Moderate hollows, such as ½ inch radius hollows, provide less bite. The most suitable hollow for a particular skate blade depends on several factors. For example, the size of the skater, the skater's skating style, and ice hardness are considered to determine the proper depth of the hollow. Also, the amount of contact a blade has with the ice surface determines the hollow radius to achieve a desired bite. The most common sizes for blade hollows are the 5/16 and 3/8 inch radius hollows.

Ice hockey skate blades differ in width. TUUK skate blades and ICM skate blades have a thicker or relatively wide blade widths. In contrast, SLM skate blades and PRO-LITE3 skate blades have thinner or relatively narrow blade widths.

Blade rocker is the curvature of the blade from the toe to heel. The amount of curvature is measured in feet as though the blade was part of a large circle. The radius of this circle is the rocker of the blade. Most ice hockey skate blades have a 7 foot to 13 foot rocker. The smaller the rocker, the less the contact the blade has with the ice surface. Once a proper blade rocker and hollow are established it is important to maintain them.

Uneven or damaged edges can occur during a game or the course of a tournament rendering the skate inoperable and limiting the maneuverability of the skater. Correcting the damaged blade is dependent on locating a person to operate a grinding machine or having access to a portable skate sharpener for emergency rink-side use.

SUMMARY OF INVENTION

The invention is directed to a portable hand held ice hockey skate blade maintenance and emergency repair tool used to supplement power grinding skate blade sharpening machines. The tool has a body having a first body member and a second body member surrounding an inner chamber. A cylindrical abrading stone located in the chamber is rotatably mounted on the body members. The outer cylindrical surface of the stone is engageable with the bottom surface of the skate blade to maintain a desired size of blade hollow and sharp blade edges in between power grindings of the blade. The cylindrical stone can be rotated within the chamber to intermittently change the working surface of the stone and extend the useful life of the stone. Threaded screws releasably hold the first and second body members in assembled relationship. The screws can be removed from the body so that the body members can be separated to provide access to stone. The stone, if worn, can then be easily replaced, or quickly interchanged with another cylindrical abrading stone having a different radius to maintain a different blade hollow size. The body has a first longitudinal slot open to the ends of the body and chamber and a second longitudinal slot radially spaced from the first slot. The second slot is open to the ends of the body and chamber. The first and second slots accommodate and guide the longitudinal exteriors of skate blades and provide access to the outer surface of the cylindrical stone during the blade sharpening procedure. The width of the first slot is different from the width of the second slot whereby skate blades having different thicknesses can be sharpened by matching the proper slot with the thickness of the skate blade. The first and second body members have inner surfaces that engage the cylindrical stone to prevent longitudinal and lateral movement of the stone relative to the body thereby minimizing skewing of the blade edges.

DESCRIPTION OF THE DRAWINGS

FIG. 13 is an enlarged sectional view taken along the line 13—13 of FIG. 12;

FIG. 14 is an enlarged sectional view taken along the line 14—14 of FIG. 12;

FIG. 15 is an enlarged sectional view taken along the line 15—15 of FIG. 12;

FIG. 16 is a perspective view of a first cylindrical abrading stone;

FIG. 17 is a perspective view of a second cylindrical abrading stone;

FIG. 18 is an enlarged sectional view taken along the line 18—18 of FIG. 3;

FIG. 19 is an enlarged sectional view taken along the line 19—19 of FIG. 3;

FIG. 20 is an enlarged sectional view taken along the line 20—20 of FIG. 3;

FIG. 21 is an enlarged sectional view taken along the line 21—21 of FIG. 3;

DESCRIPTION OF PREFERRED EMBODIMENTS

Figure 1:
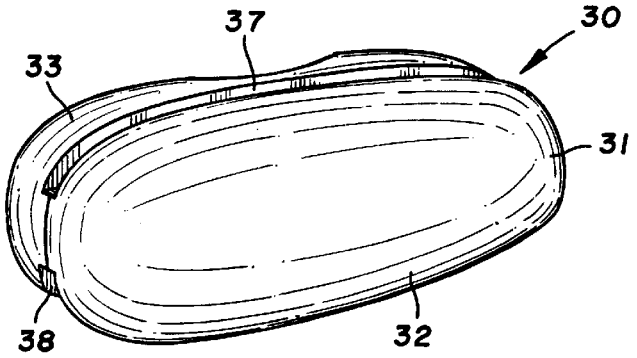
FIG. 1 is a perspective view of the ice skate blade resurfacer of the invention.
Figure 2:
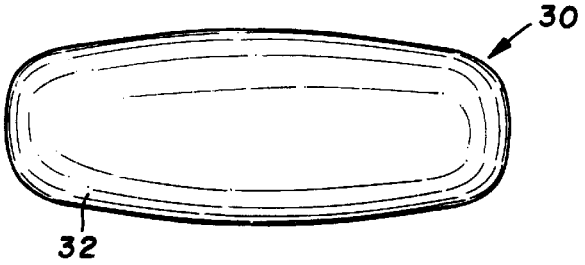
FIG. 2 is a side elevational view thereof of the right side of FIG. 1.
Figure 3:
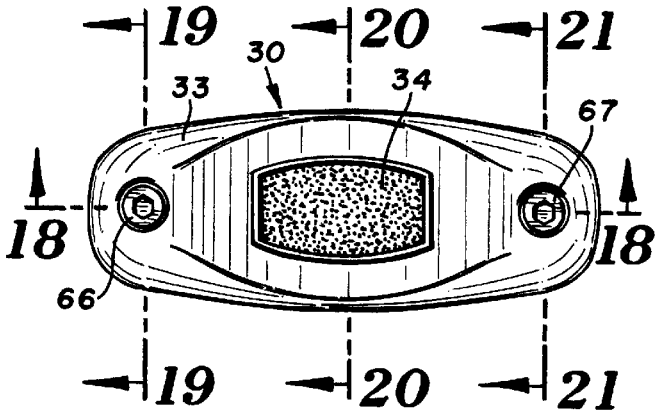
FIG. 3 is a side elevational view thereof of the left side of FIG. 1.
Figure 4:
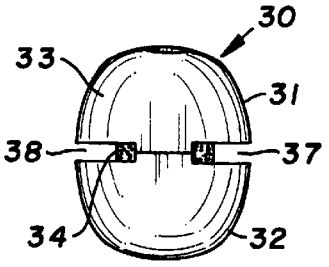
FIG. 4 is an end elevational view thereof.
Figure 5:
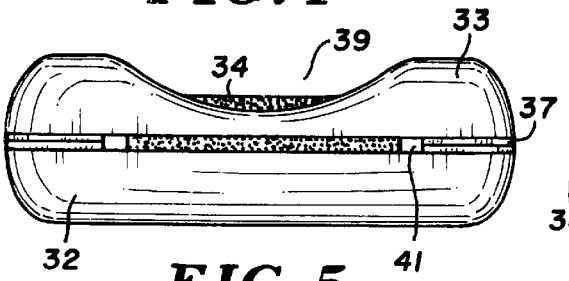
FIG. 5 is a top plan view thereof.
Figure 6:
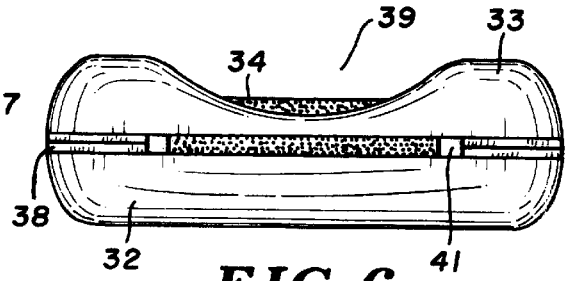
FIG. 6 is a bottom plan view thereof.

Referring to FIGS. 1 and 2, there is shown an ice hockey skate blade resurfacer or sharpener indicated generally at 30. Skate blade sharpener 30 is used as an ice hockey skate blade maintenance and emergency repair tool which supplements a power skate blade grinding machine to restore edge sharpness of an ice hockey skate blade. Sharpener 30 corrects and tunes mild edge deterioration to restore the bite and added traction of the skate blade on an ice surface in between grindings of the blade with a power grinder. Several tuning sessions or sharpening procedures can be performed with sharpener 30 before the skater may find it necessary to power grind the skate blade. Following a program to maintain edge sharpness with sharpener 30 allows the skater to experience a consistent edge feel each time the skater skates on an ice surface. Sharpener 30 is a portable skate sharpening tool useable for rink side or game-time emergency repairs and maintaining consistent blade edges and blade rockers between grindings with a skate grinding machine. Sharpener 30 has two blade slots 37 and 38, one relatively narrow and the other relatively wide, and accommodates interchangeable cylindrical abrading or grinding stones 34 and 36 having different radii whereby substantially all types and sizes of ice hockey skate blades can be sharpened to have the most common hollow grinds.

Referring to FIGS. 1 to 6, sharpener 30 has a generally cylindrical shaped body 31 having an inner chamber 41 accommodating a cylindrical abrading stone 34. Body 31 is a two-piece member made of a relatively dense and rigid metal material. Body 31 has a first body member 32 and a second body member 33 surrounding chamber 41. Stone 34 is rotatably mounted on body members 32 and 33 within chamber 41. Stone 34 can be rotated in chamber 41 to expose unused outer surface portions of the stone for blade sharpening thereby extending the period of usefulness of the stone. As seen in FIG. 16, stone 34 is a cylindrical shaped abrading member having a relatively wide radius, such as a ⅜ inch radius for grinding ⅜ inch blade hollows. As seen in FIG. 17, stone 36 is a cylindrical shaped abrading having a smaller radius, such as a 5/16 inch radius, and a longer length than stone 34. Stone 36 is used to grind 5/16 inch blade hollows. Stone 36 can be interchanged with stone 34 in chamber 41 as hereinafter described. The length of stone 34 is less than the length of stone 36 to prevent confusion between the stones and their use to grind different sized blade hollows. A pair of fasteners, such as threaded long cap screws 66 and 67 threaded into body 31 releasably hold body members 32 and 33 together and retain stone 34 within chamber 41. A hex wrench (not shown) can be used to tighten and loosen screws 66 and 67. Screws 66 and 67 can be removed from body 31 to separate body members 32 and 33 so that stones 34 and 36 can be interchanged.

Body 31 has longitudinal slots 37 and 38 located on opposite sides of body 31. Slots 37 and 38 are open to the ends of body 31 and to chamber 41 to expose the outer surface of stone 34 for blade sharpening. Slot 37 has a width that is wider than the width of slot 38 so that ice hockey skate blades having different blade thicknesses can be sharpened with sharpener 30. For example, slot 37 accommodates ice hockey skate blades having a relatively wide blade thickness, such as the blades of ICM skates or TUUK skates, where slot 38 accommodates ice hockey skate blades having a relatively narrow blade thickness, such as the blade of SLM skates or PRO-LITE3 skates.

One side of body 31 has a transverse groove or U-shaped recess 39 having a bottom opening 54 adjacent one side of chamber 41. The outer surface of stone 34 extends through opening 54 into groove 39 thereby providing access to stone 34 so the stone can be rotated. Stone 34 is intermittently rotated to expose an unused abrading or working surface of the stone adjacent slots 37 and 38 thereby extending the period of usefulness of the stone.

Referring to FIGS. 7 to 11, first body member 32 has a convex curved outer surface and generally flat inner surfaces 77 and 78. Inner surface 77 extends downwardly from the top of body 31 and is located normal to a horizontal plane tangent to the outer surface of stone 34 exposed in slot 37. Surface 77 functions to guide an ice hockey skate blade located in slot 37. Inner surface 78 extends upwardly from the bottom of body 31 and is located normal to a horizonal plane tangent to the outer surface of stone 34 exposed in slot 38. Surface 78 functions to guide a skate blade located in slot 38.

Figure 7:
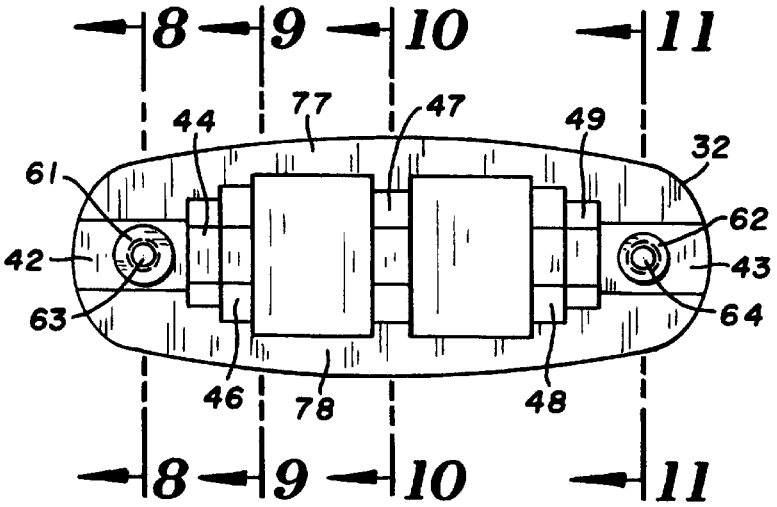
FIG. 7 is an inside plan view of the first body member without the cylindrical abrading stone.

Body member 32 has a pair of shoulders 42 and 43 on opposite ends thereof. Shoulders 42 and 43 project inwardly from inner surfaces 77 and 78 of body member 32. As seen in FIG. 7, shoulder 42 is located adjacent the front end of body member 32. Shoulder 43 is located adjacent the rear end of body member 32. Shoulders 42 and 43 are generally rectangular shaped members having generally flat inner surfaces which are aligned and cooperate with the flat inner surfaces of the inwardly projecting shoulders 52 and 53 of body member 33 to laterally space the inner surfaces 77 and 78 of body member 32 from the inner surfaces 79 and 81 of body member 33.

Figure 9:
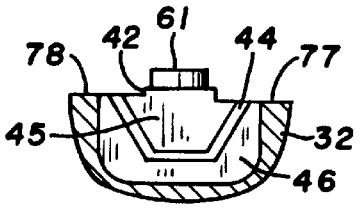
FIG. 9 is an enlarged sectional view taken along the line 9—9 of FIG. 7.
Figure 8:
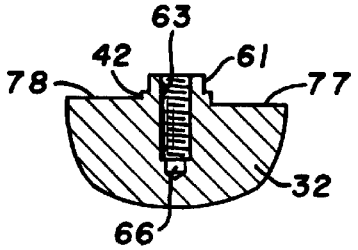
FIG. 8 is an enlarged sectional view taken along the line 8—8 of FIG. 7.
Figure 10:
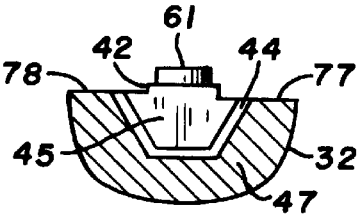
FIG. 10 is an enlarged sectional view taken along the line 10—10 of FIG. 7.
Figure 11:
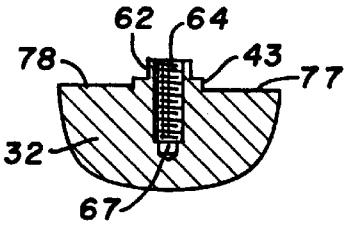
FIG. 11 is an enlarged sectional view taken along the line 11—11 of FIG. 7.
Figure 12:
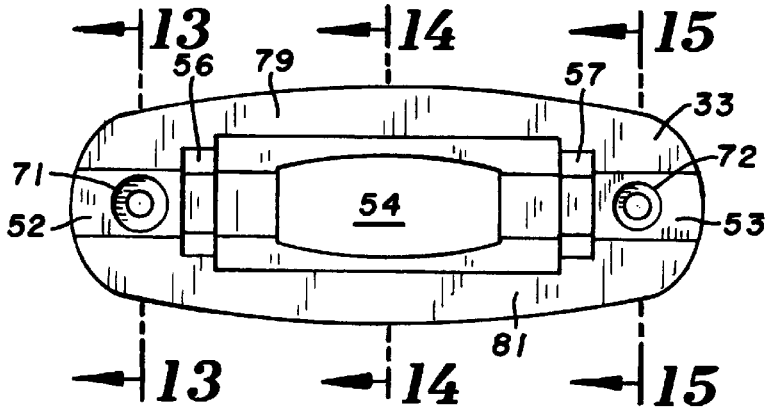
FIG. 12 is an inside plan view of the second body member without the cylindrical abrading stone.
Figure 22:
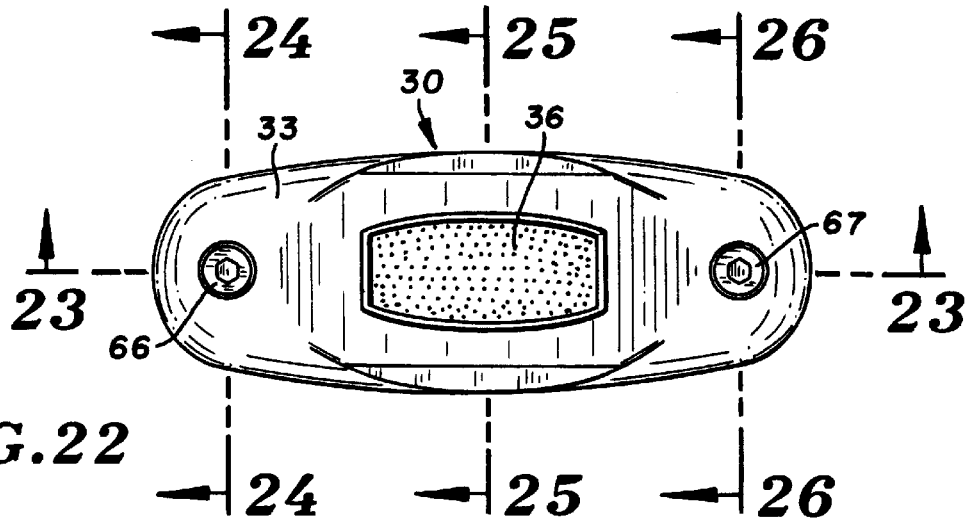
FIG. 22 is a side elevational view of the ice skate blade resurfacer similar to FIG. 3 having the cylindrical abrading stone of FIG. 17.

Body member 32 has a plurality of inwardly directed V-shaped cradles or steps 44, 46, 47, 48 and 49 rotatably supporting stones 34 and 36. As shown in FIG. 18, the outer ends of stone 34 engage the upright flat inner surfaces of outer steps 44 and 49 to prevent longitudinal movement of stone 34 relative to body 31. The outer surface of stone 34 engages the inner surfaces of steps 46, 47 and 48 to prevent lateral movement of stone 34 relative to body 31. When stone 34 is rotated in chamber 41, the outer surface of stone 34 rubs against the upright inner surfaces of steps 44 and 49 and against the inner surfaces of steps 46–48. Steps 44 and 49 are identical, generally V-shaped members having a vertical middle section joined to outwardly inclined end sections. Steps 44 and 49 are located adjacent opposite ends of body member 32. As shown in FIGS. 9 and 10, step 44 projects inwardly into chamber 41 from the inner surfaces of step 46. The middle section of step 44 has a length which is less than the length of the middle section of step 46 and is located in front of step 46 to accommodate the one end of stone 36. Step 49 projects inwardly into chamber 41 from the inner surface of step 48. The middle section of step 49 has a length less than the length of the middle section of step 48 and is located behind step 48 to accommodate the opposite end of stone 36. Steps 46–48 are identical, longitudinally spaced V-shaped members having a vertical middle section joined to outwardly inclined end sections. Steps 46–48 are located between steps 44 and 49.

Figure 23:
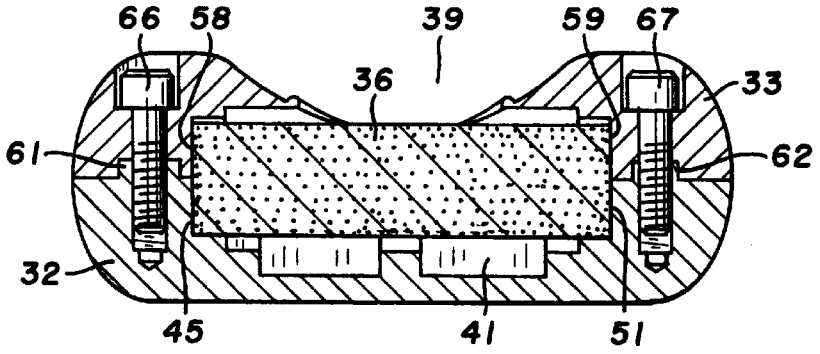
FIG. 23 is an enlarged sectional view taken along the line 23—23 of FIG. 22.
Figure 24:
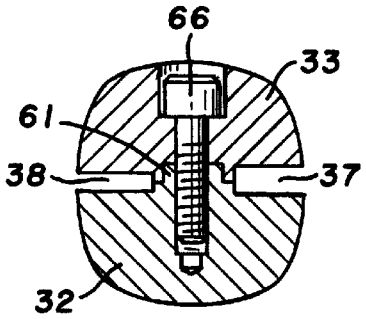
FIG. 24 is an enlarged sectional view taken along the line 24—24 of FIG. 22.
Figure 25:
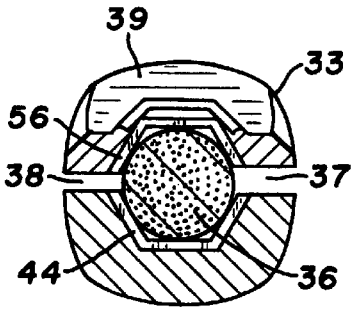
FIG. 25 is an enlarged sectional view taken along the line 25—25 of FIG. 22.
Figure 26:
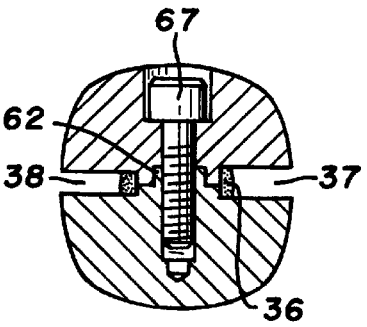
FIG. 26 is an enlarged sectional view taken along the line 26—26 of FIG. 22.

Referring to FIG. 23, body member 32 has upright walls 45 and 51 that engage the outer ends of cylindrical abrading stone 36 to prevent longitudinal movement of stone 36 relative to body 31. Upright walls 58 and 59 of body member 33 engage the outer ends of stone 36 adjacent walls 45 and 51.

Threaded bores 63 and 64 extended into the opposite ends of body member 32 threadably receive screws 66 and 67 to hold body members 32 and 33 in assembled relationship. The inner ends of threaded bores 63 and 64 are aligned and in communication with bores 68 and 69 in the opposite ends of body member 33. An annular sleeve 61 projecting inwardly from shoulder 42 surrounds the inner end of threaded bore 61. Sleeve 61 is accommodated by the enlarged end 71 of bore 68. The outer diameter of sleeve 61 is substantially the same as the diameter of end 71 whereby sleeve 61 has a close-fit relationship with end 71. Annular sleeve 62 projects inwardly from shoulder 43 on the opposite end of body member 32. Sleeve 62 surrounds the inner end of threaded bore 64 and is accommodated by the enlarged inner end 72 of bore 69. The outer diameter of sleeve 62 is substantially the same as the diameter of end 72 whereby sleeve 62 has a close-fit relationship with end 72 to prevent lateral and longitudinal shifting or relative movement between body members 32 and 33. The outer diameter of sleeve 61 is larger than the diameter of enlarged bore end 72 so that sleeve 61 cannot fit within end 72 to assemble body members 32 and 33 whereby body members 32 and 33 have a single assembled relationship. This ensures that inner surface 77 of body member 32 is aligned with inner surface 79 of body member 33 and that inner surface 78 is aligned with inner surface 81 to define slots 37 and 38 when body members 32 and 33 are in assembled relationship.

Referring to FIGS. 12 to 15 body member 33 has inner surfaces 79 and 81 that extend parallel to the inner surfaces 77 and 78 of body member 32. Inner surfaces 79 and 81 are generally flat and function to guide a blade being moved lengthwise in slots 37 and 38. The transverse space between the inner surfaces 77, 79 and 78, 81 of body members 32 and 33 defines the widths of slots 37 and 38. Inner surfaces 77, 79 and 78, 18 are located normal to a horizontal plane tangent to the outer surface of stone 34. Inner surfaces 77 and 79 are transversely spaced at a wider distance than inner surfaces 78 and 81. Body member 33 has a pair of V-shaped ribs or steps 56 and 57 opposite steps 44 and 49 for rotatably supporting the ends of stone 36. The inner surfaces of body member 33 opposite steps 46–48 rotatably support stone 34. A transverse groove 39 having a bottom opening 54 open to chamber 41 is located between steps 56 and 57. Stones 34 and 36 are accessible through opening 54 for rotation thereof.

In use, the blade of an ice hockey skate is positioned with the edges of the blade facing upwardly. If a ⅜ inch radius blade hollow is desired, as shown in FIGS. 18 to 21, stone 34 is placed in chamber 41. The longitudinal exterior of the skate blade is aligned with either slot 37 or slot 38, depending on the thickness of the blade, and moved into engagement with stone 34. Sharpener 30 is moved back and forth lengthwise along the blade using minimal downward pressure. Honing oil can be used to lubricate the blade during the sharpening process to reduce friction between the inner surfaces 77, 79 and 78, 81 and the sides of the blade. After 10 to 15 strokes, sharpener 30 is lifted off the skate blade so that stone 34 can be slightly rotated with the thumb or finger of the operator to position an unused working surface of stone 34 adjacent slot 37, 38. Stone 34 can be rotated without releasing the operator's grip from sharpener 30. Sharpener 30 is reinstalled on the blade by positioning the blade in slot 37, 38 into engagement with stone 34 and resuming light pressure stroking in both longitudinal directions. The rotation of stone 34 and blade stroking are repeated until a lip or burr has formed on both sides of the blade. The number of strokes necessary to sharpen the edges of the blade depends on the degree of hardness of the skate blade, i.e. carbon steel blades are moderately hard and require less strokes while stainless steel blades are often very hard and require more strokes. A flat stone (not shown) is used to finish the sides of skate blade to remove the burrs from the blade.

If a 5⁄16 inch radius blade hollow is desired, as shown in FIGS. 22 to 26, screws 66 and 67 are removed from body 31 and body members 32 and 33 are separated. Stone 34 is replaced with stone 36 and body members 32 and 33 are reassembled. Sleeve 61 has an outside diameter substantially the same as the diameter of enlarged end 71 but larger than the diameter of enlarged end 72 to ensure proper assembly of body members 32 and 33. Threaded screws 66 and 67 threaded into body 31 releasably hold body members 32 and 33 together and retain stone 36 within chamber 41. The skate blade is aligned with the matching slot 37, 38 and moved into engagement with stone 36. Sharpener 30 is moved in both longitudinal directions to maintain the blade hollow and sharpen the edges of the blade.

The ice skate blade resurfacer of the invention has been illustrated and described as a preferred embodiment. Modifications in structure, arrangement of structures, and materials may be made without departing from the invention. The invention is defined in the following claims.

It is claimed:

1. A resurfacer for a skate blade having a bottom surface with edges comprising: a body having a first body member, a second body member and opposite ends, said members surrounding an inner chamber, a cylindrical member located in the chamber and rotatably mounted on the body members, and means releasably holding the first and second body members and cylindrical member in an assembled position, the cylindrical member having an outer surface engageable with a bottom surface of a skate blade for sharpening the edges of the blade, the body having a first longitudinal slot open to the ends of the body and chamber and a second longitudinal slot open to the ends of the body and chamber whereby the cylindrical member is accessible through the first and second slots, the second longitudinal slot being radially spaced from the first longitudinal slot, the body members having means engageable with the cylindrical member to prevent longitudinal and lateral movement of the cylindrical member relative to the body, the means engageable with the cylindrical member comprising first cradle means having upright inner surfaces engaging the outer ends of the cylindrical member and second cradle means having inner surfaces engaging the outer surfaces of the cylindrical member.

2. The resurfacer of claim 1 wherein: the first longitudinal slot has a width different from the width of the second longitudinal slot.

3. The resurfacer of claim 1 wherein: the cylindrical member is a 5⁄16 inch radius cylindrical abrading stone.

4. The resurfacer of claim 1 wherein: the cylindrical member is a ⅜ inch radius cylindrical abrading stone.

5. The resurfacer of claim 1 including: means projecting from the first body member into the second body member when the body members are in the assembled position.

6. The resurfacer of claim 1 wherein: at least one of the body members has a groove open to the chamber to permit the cylindrical member to be manually rotated.

7. The resurfacer of claim 6 wherein: the groove is spaced from the first and second slots.

8. A resurfacer for a skate blade having a bottom surface with edges comprising: a body having a first body member, a second body member and opposite ends, said members surrounding an inner chamber, a cylindrical member located in the chamber and rotatably mounted on the body members, means releasably holding the first and second body members and cylindrical member in an assembled position, the cylindrical member having an outer surface engageable with a bottom surface of a skate blade for sharpening the edges of the blade, the body having a first longitudinal slot open to the ends of the body and chamber and a second longitudinal slot open to the ends of the body and chamber whereby the cylindrical member is accessible through the first and second slots, the second longitudinal slot being radially spaced from the first longitudinal slot, the body members having means engageable with the cylindrical member to prevent longitudinal and lateral movement of the cylindrical member relative to the body and means projecting from the first body member into the second body member when the body members are in the assembled position, the means projecting from the first body member into the second body member comprises a first annular sleeve on one end of the first body member and a second annular sleeve on the opposite end of the first body member, the first annular sleeve having a diameter different from the diameter of the second annular sleeve.

9. The resurfacer of claim 8 wherein: at least one of the body members has a groove open to the chamber.

10. The resurfacer of claim 9 wherein: the groove is spaced from the first and second slots.

11. A tool for maintaining sharp edges of an ice skate blade comprising: a body having opposite ends, a first body member and a second body member having bores, said members surrounding an inner chamber, a first cylindrical member located in the chamber and rotatably mounted on the body members, a second cylindrical member interchangeable with the first cylindrical member selectively accommodated by the chamber, and means releasably holding the first and second body members in an assembled position, means projecting from the first body member into the bores in the second body member when the body members are in the assembled position comprising a first annular sleeve on one end of the first body member and a second annular sleeve on the opposite end of the first body member, the first annular sleeve having a diameter different from the diameter of the second annular sleeve, the first and second cylindrical members each having an outer surface engageable with the bottom surface of a skate blade for sharpening the edges of the blade, the body having a first longitudinal slot open to the ends of the body and the chamber and a second longitudinal slot open to the ends of the body and the chamber radially spaced from the first longitudinal slot to selectively accommodate the blade.

12. The tool of claim 11 wherein: the first longitudinal slot has a width different from the width of the second longitudinal slot.

13. The tool of claim 11 wherein: the first cylindrical member has a length different from the length of the second cylindrical member.

14. The tool of claim 11 wherein: the first cylindrical member has a radius size different from the radius size of the second cylindrical member.

15. The tool of claim 14 wherein: the first cylindrical member is a 5/16 inch radius cylindrical abrading stone.

16. The tool of claim 14 wherein: the second cylindrical member is a ⅜ inch radius cylindrical abrading stone.

17. The tool of claim 11 wherein: at least one of the body members has a groove open to the chamber.

18. The tool of claim 17 wherein: the groove is spaced from the first and second slots.

19. A tool for maintaining sharp edges of an ice skate blade comprising: a body having opposite ends, a first body member and a second body member, said members surrounding a chamber, a first cylindrical member located in the chamber and rotatably mounted on the body members, a second cylindrical member interchangeable with the first cylindrical member selectively accommodated by the chamber, and means releasably holding the first and second body members in an assembled position, the first and second cylindrical members each having an outer surface engageable with the bottom surface of a skate blade for sharpening the edges of the blade, the body members having first means engageable with the first cylindrical member and second means engageable with the second cylindrical member to prevent longitudinal and lateral movement of the first and second cylindrical members, the body having a first longitudinal slot open to ends of the body and the chamber and a second longitudinal slot open to the ends of the body and the chamber whereby each cylindrical member is accessible through the first and second slots, the second longitudinal slot radially spaced from the first longitudinal slot.

20. The tool of claim 19 wherein: one of the body members has groove means having a bottom opening open to the chamber.

* * * * *